US006511107B2

(12) United States Patent
Barczynski et al.

(10) Patent No.: US 6,511,107 B2
(45) **Date of Patent: *Jan. 28, 2003**

(54) ELECTRICALLY CONTROLLED ACTUATOR FOR A VEHICLE DOOR LATCH ASSEMBLY

(75) Inventors: Darek Barczynski, Farmington Hills, MI (US); Roman Cetnar, Newmarket (CA); Greogy A. Jorgensen, Oxford, MI (US); Andrew Baranowski, Windsor (CA); Frank Abulnar, Farmington Hills, MI (US); Ann-Margaret Mozola, Northville, MI (US); Maciek Bigoszewski, Royal Oak, MI (US); Jerzy Kopiec, Commerce, MI (US); Venkateswar Sagi, Novi, MI (US)

(73) Assignee: Atoma International Corp., Newmarket (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/873,819

(22) Filed: Jun. 4, 2001

(65) Prior Publication Data

US 2001/0024041 A1 Sep. 27, 2001

Related U.S. Application Data

(62) Division of application No. 09/334,347, filed on Jun. 16, 1999, now Pat. No. 6,328,353.

(51) Int. Cl.[7] ..... E05C 3/06

(52) U.S. Cl. ..... 292/216; 292/DIG. 23

(58) Field of Search ..... 292/201, 216, 292/DIG. 23; 74/2, 569, 89.18, 89.19

(56) References Cited

U.S. PATENT DOCUMENTS 4,440,006 A 4/1984 Kleefeldt (List continued on next page.)

FOREIGN PATENT DOCUMENTS

| | | |
|---|---|---|
| EP | 0397966 | 11/1990 |
| EP | 0478013 | 4/1992 |
| EP | 0834631 | 4/1998 |

*Primary Examiner*—Gary Estremsky
(74) *Attorney, Agent, or Firm*—Howard & Howard

(57) ABSTRACT

A vehicle door latch assembly is moveable between an unlocked condition, a locked condition and a double locked condition. The door latch assembly has a support housing with a cover having a projecting block. A cam is rotatably mounted to the cover and includes an integral notch defining a pair of stops for selective engagement with the block. A rocker is movably mounted to the cover for selectively engaging at least one of the stops of the notch within the cam. A first controller rotates the cam into selective engagement with the block and the rocker for defining the unlocked condition and the locked condition, respectively, of the door lock. A second controller rotates the rocker to release the rocker from one of the stops of the notch to allow further rotation of the cam from the locked condition to the double locked condition.

31 Claims, 9 Drawing Sheets

U.S. PATENT DOCUMENTS 5,000,495 A 3/1991 Wolfgang et al.
5,106,134 A 4/1992 Thau
5,137,312 A * 8/1992 Tang ..... 292/336.3
5,154,457 A 10/1992 Watanabe
5,350,206 A 9/1994 Akahori et al.
5,464,260 A 11/1995 Bartel et al.
5,474,339 A 12/1995 Johnson
5,538,298 A 7/1996 Ikeda
5,577,583 A 11/1996 O'Donnell
5,582,444 A 12/1996 Hayakawa et al.
5,603,537 A * 2/1997 Amano ..... 292/201
5,615,564 A 4/1997 Inoue
5,634,677 A 6/1997 Buscher et al.
5,683,125 A 11/1997 Tseng
5,699,685 A 12/1997 Jahrsetz
5,899,508 A 5/1999 Cetnar
5,961,163 A 10/1999 Brackmann et al.
6,019,402 A * 2/2000 Arabia ..... 292/216
6,328,353 B1 * 12/2001 Barczynski ..... 292/216

* cited by examiner 76
78
118
114
10
54
56
62
64
36
34
38
116
42
16
50
32
58

10
16
32
54
50
38
48
46
32
60
44
62
56
58
64
36
116
34
42

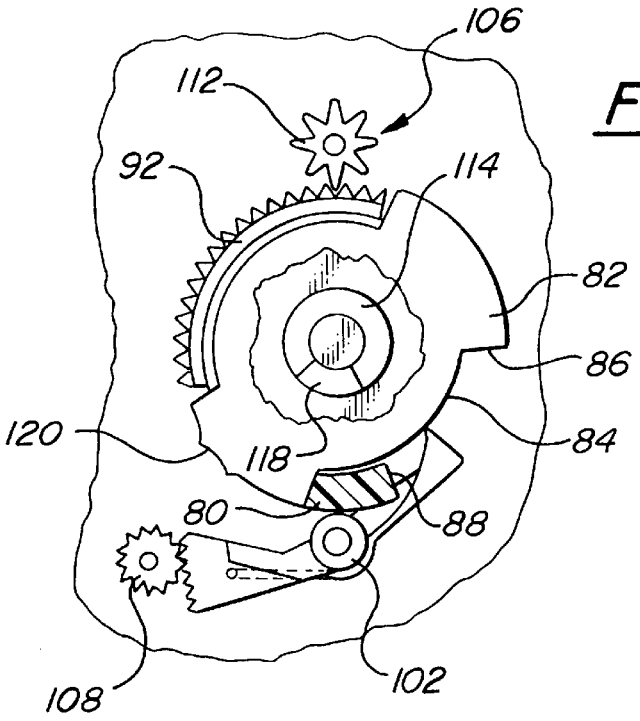
FIG-10
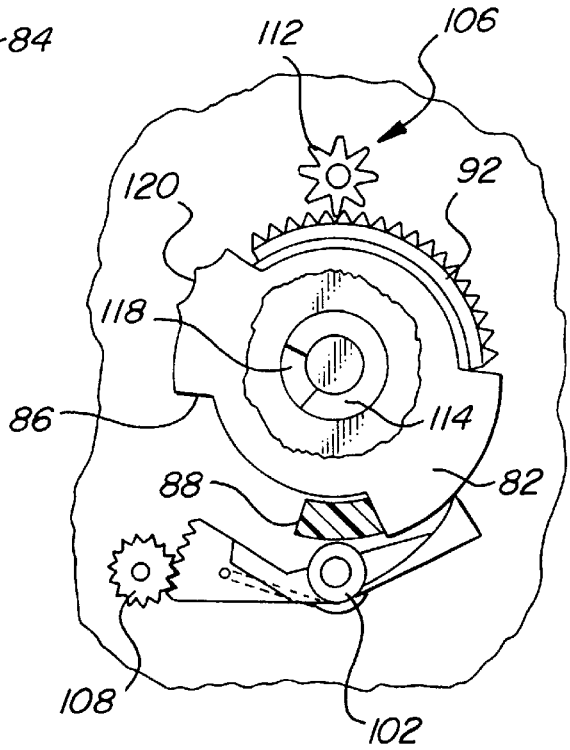
FIG-12
FIG-11
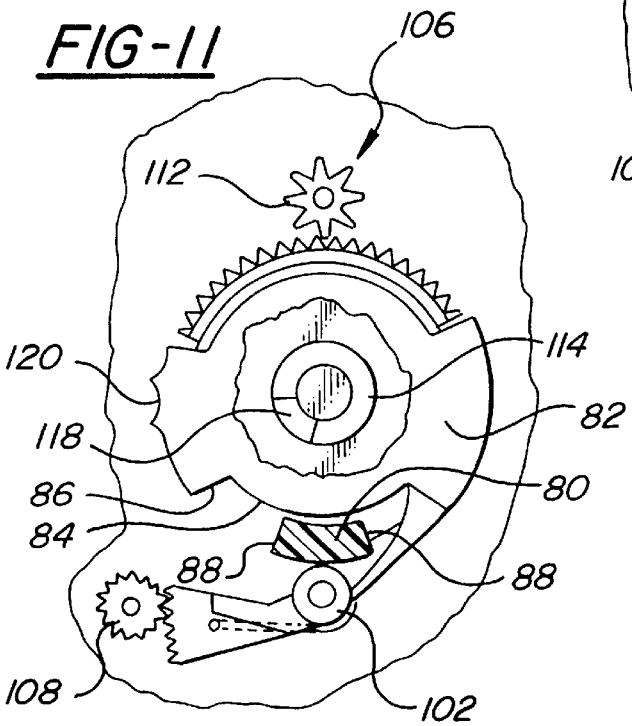

ELECTRICALLY CONTROLLED ACTUATOR FOR A VEHICLE DOOR LATCH ASSEMBLY

RELATED APPLICATION

The subject patent application is a divisional of U.S. patent application Ser. No. 09/334,347, filed on Jun. 16, 1999, which is now issued as U.S. Pat. No. 6,328,353.

BACKGROUND OF THE INVENTION

1) Technical Field

The subject invention relates to vehicle door latch assemblies having both manual and power door locking features.

2) Description of the Prior Art

Vehicles, such as passenger cars, are commonly equipped with individual door latch assemblies which secure respective passenger and driver side doors to the vehicle. Each door latch assembly is typically provided with manual release mechanisms or lever for unlatching the door latch from the inside and outside of the vehicle, e.g. respective inner and outer door handles. In addition, many vehicles also include an electrically controlled actuator for remotely locking and unlocking the door latches.

As is commonly known, the release mechanisms may be actuated to lock the door latch assembly and prevent release of the outer door handle. However, a thief may break a window of the vehicle and reach inside to manually unlock the latch assembly by actuating the inner door handle. The industry has therefore developed door latch assemblies which have a "double lock" or anti-theft feature which also locks the inner door handle such that neither handle may be actuated to open the door.

The double lock or anti-theft feature is typically accomplished by the electrically controlled actuator and cannot be done manually. This helps ensure that the passengers are outside of the vehicle when the double lock feature is engaged. Examples of prior art door latch assemblies which incorporate a double lock feature are shown in U.S. Pat. Nos. 5,464,260 and 5,474,339. However, the prior art door latch assemblies incorporating the double lock feature have a number of deficiencies.

One primary deficiency relates to the electrical movement of the actuator between an unlocked condition, a locked condition and a double locked condition. A number of elements are actuated within the door latch assembly as the actuator moves between these conditions. The actuator is typically connected to an electric motor which controls the movements. The electric motor must be actuated a predetermined amount in order to move the actuator through the desired conditions. As appreciated, electric motors are susceptible to changes in temperature, moisture, and voltage such that the desired actuation of the electric motor may not be consistently and accurately achieved. Hence, it is desirable to have an electrically controlled actuator which incorporates at least three physical stops to ensure the proper movement of the actuator between the three different conditions.

SUMMARY OF THE INVENTION AND ADVANTAGES

A vehicle door latch assembly moveable between an unlocked condition, a first locked condition and a second locked condition. The door latch assembly comprises a support housing. A cover is mounted to the support housing and has at least one projecting abutment. A ratchet is pivotally mounted to the support housing and moveable or pivotable between a latched position and an unlatched position. A pawl is mounted to the support housing and has first and second ends with the pawl moveable between a blocking position wherein the first end abuts the ratchet to secure the ratchet in the latched position and a release position wherein the first end disengages the ratchet to permit the ratchet to pivot toward the unlatched position. A release mechanism is mounted to the support housing for selectively moving the pawl into the release position. A coupler is selectively coupled between the second end of the pawl and the release mechanism. The coupler moves between an engaged position aligned with the release mechanism and a disengaged position spaced from the release mechanism. A cam is rotatably mounted to the cover and includes a camming surface defining at least one stop for selective engagement with the abutment. A transfer element is mounted to the cam and engages the coupler for transferring the rotation of the cam into the movement of the coupler. A rocker is movably mounted to the cover for selectively engaging the camming surface of the cam. A first controller rotates the cam and moves the transfer element between a first position wherein the stop engages the abutment and the rocker engages the camming surface with the coupler engaged with the release mechanism for defining the unlocked condition of the door lock; a second position wherein the rocker engages the stop to prevent further rotation of the cam with the coupler disengaged with the release mechanism to define the first locked condition; and a third position wherein the stop engages the abutment and the rocker is released from the camming surface with the coupler disengaged further from the release mechanism to define the second locked condition. A second controller rotates the rocker to release the rocker from the camming surface during rotation of the cam from the second position to the third position.

Accordingly, the subject invention incorporates at least three separate physical stops for ensuring that the correct rotation of the cam and transfer element is achieved. The subject invention also incorporates a novel means of providing the second locked condition or double lock feature for the door lock assembly.

BRIEF DESCRIPTION OF THE DRAWINGS

Other advantages of the present invention will be readily appreciated as the same becomes better understood by reference to the following detailed description when considered in connection with the accompanying drawings wherein:

FIG. 10 is a detailed view of a cam and a rocker of the electrical actuator in the unlocked condition;

FIG. 11 is a detailed view of the cam and rocker in the first locked condition;

FIG. 12 is a detailed view of the cam and rocker in the second locked condition.

DETAILED DESCRIPTION OF THE PREFERRED EMBODIMENT

Figure 1:
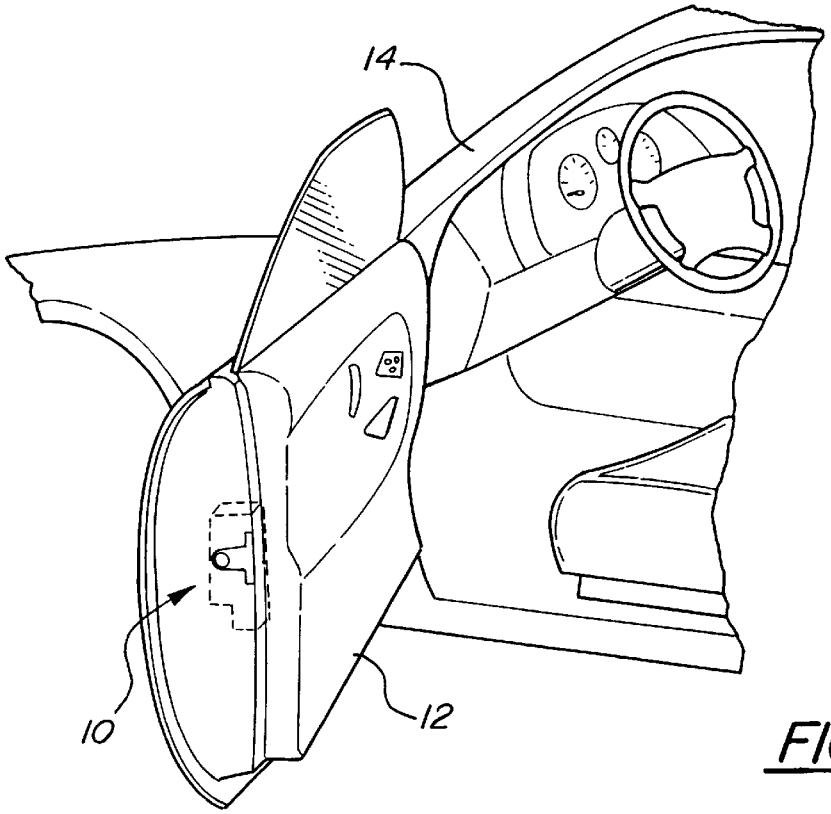
FIG. 1 is a perspective view of a vehicle door mounted to a passenger vehicle incorporating the subject invention.

Referring to the Figures, wherein like numerals indicate like or corresponding parts throughout the several views, a vehicle door latch assembly is generally shown at 10 in FIGS. 1 through 4. The door latch assembly 10 is mounted to a driver's side vehicle door 12 of a passenger vehicle 14 as is known in the art. As appreciated, the door latch assembly 10 may be mounted to the front and rear passenger side doors and may be incorporated into a sliding side door, rear door, a rear hatch or a lift gate.

Referring to FIGS. 2 through 5, the door latch assembly 10 comprises a support housing 16 of any suitable design or configuration. A ratchet 18 is pivotally mounted to the support housing 16 between a latched position and an unlatched position. For illustrative purposes, the ratchet 18 is shown in the unlatched position in FIG. 4. As appreciated, a striker pin 20, shown in phantom, extends from a door jam of the vehicle 14 to engage the ratchet 18. An opening 22 is provided in the housing 16 for receiving the striker pin 20. The ratchet 18 surrounds the striker pin 20 when in the latched position which secures the door latch assembly 10, and subsequently the door 12, to the vehicle 14. A latch spring 24 continuously biases the ratchet 18 toward the unlocked position. The design of the ratchet 18 is of any suitable configuration as is known in the art.

A pawl 26, having first 28 and second 30 ends, is pivotally mounted to the support housing 16. The pawl 26 moves between a blocking position wherein the first end 28 abuts the ratchet 18 to secure the ratchet 18 in the latched position and a release position wherein the first end 28 disengages the ratchet 18 to permit the ratchet 18 to pivot toward the unlatched position. Preferably, the pawl 26 has a locking face and the ratchet 18 has at least one corresponding locking face such that the two faces engage each other during the blocking of the pawl 26 with the ratchet 18.

A release mechanism 32 is mounted to the support housing 16 for selectively moving the pawl 26 into the release position. The door latch assembly 10 is characterized by a coupler, generally shown at 34, selectively coupled between the second end 28 of the pawl 26 and the release mechanism 32. The pawl 26, release mechanism 32 and coupler 34 are illustrated best in FIGS. 4 and 5.

Figure 6:
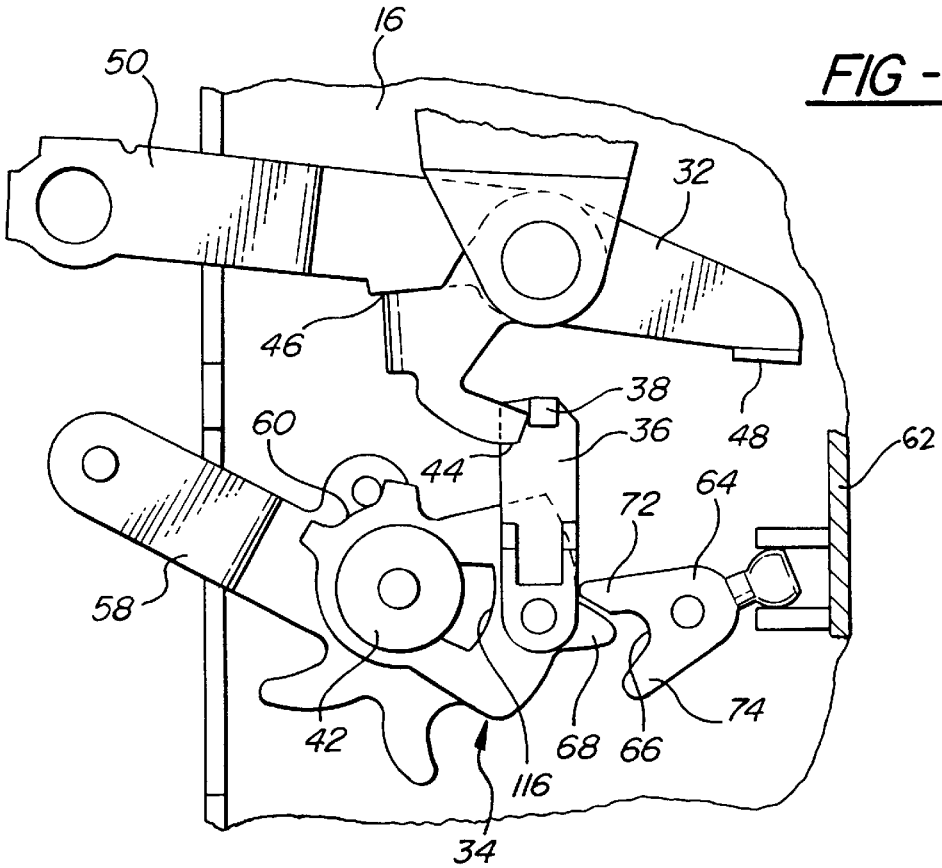
FIG. 6 is a detailed view of a coupler and the release mechanism of the door latch assembly in an unlocked condition.
Figure 7:
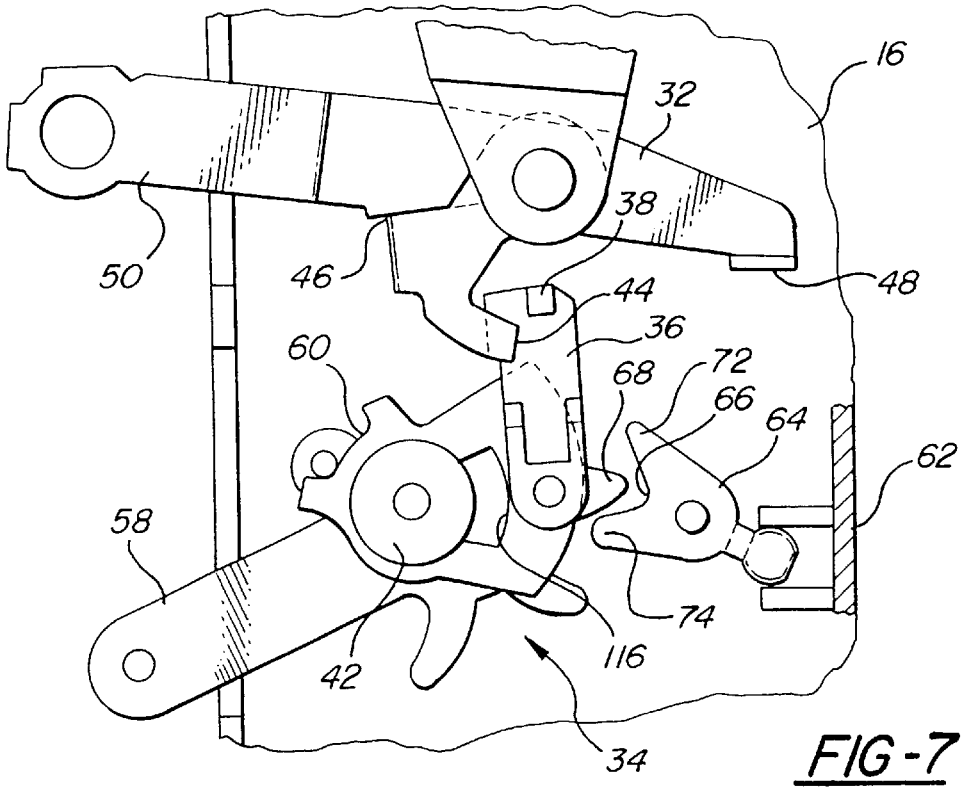
FIG. 7 is a detailed view of the coupler and release mechanism in a first locked condition.
Figure 8:
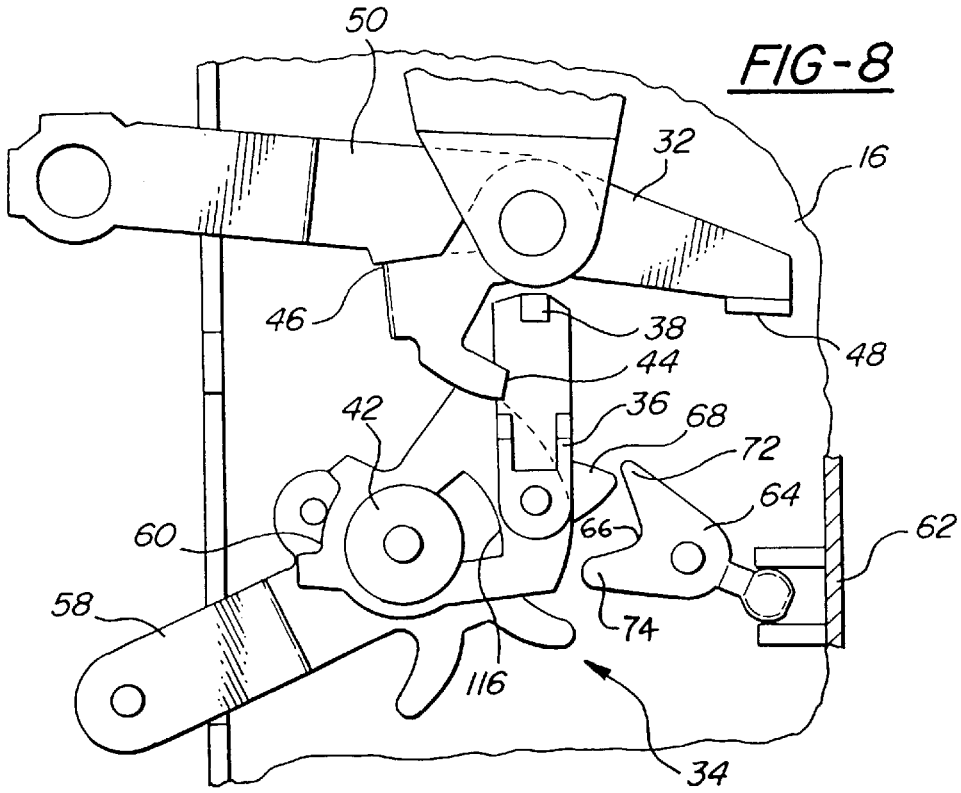
FIG. 8 is a detailed view of the coupler and release mechanism in a second locked condition.
Figure 9:
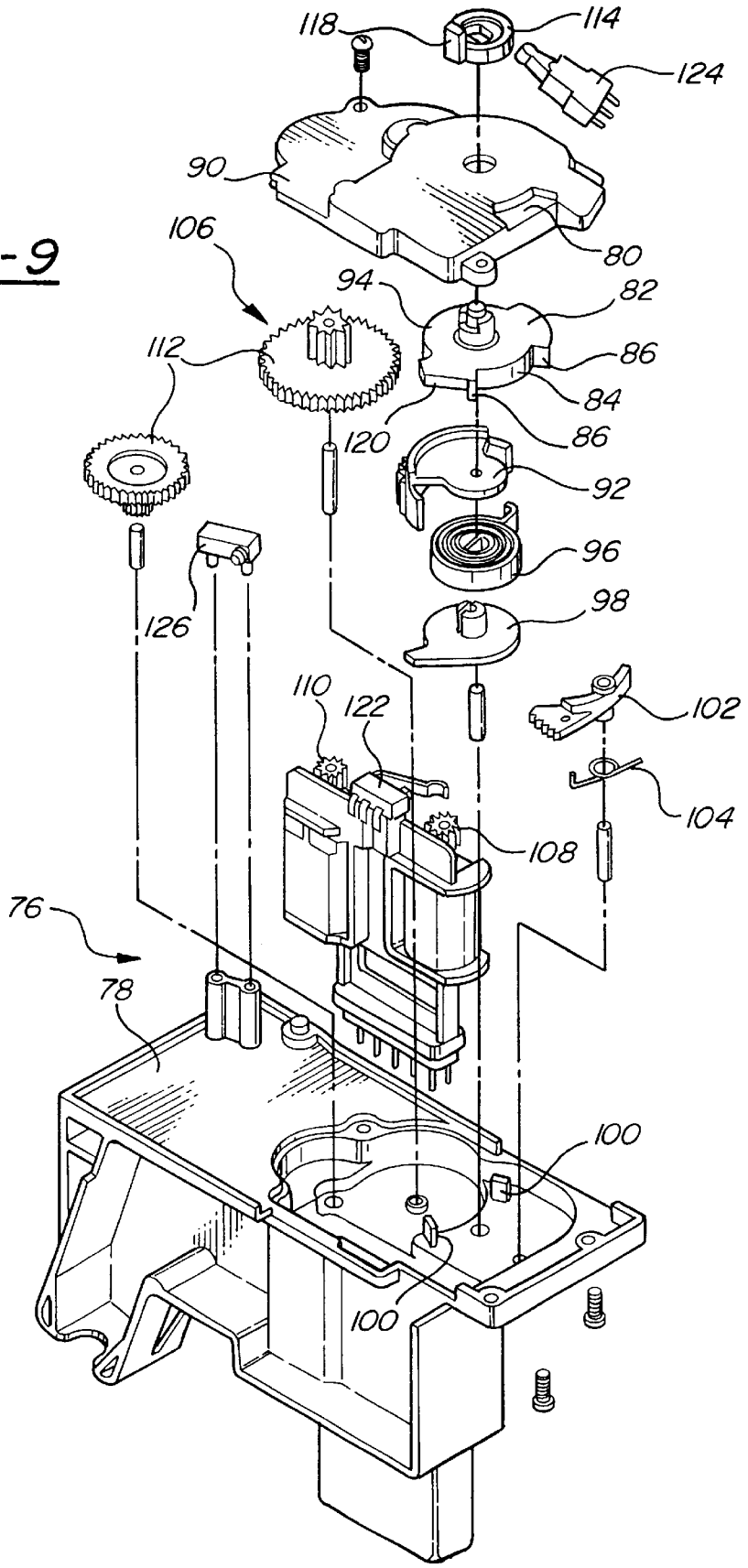
FIG. 9 is an exploded perspective view of the electrically controlled actuator.
Figure 13:
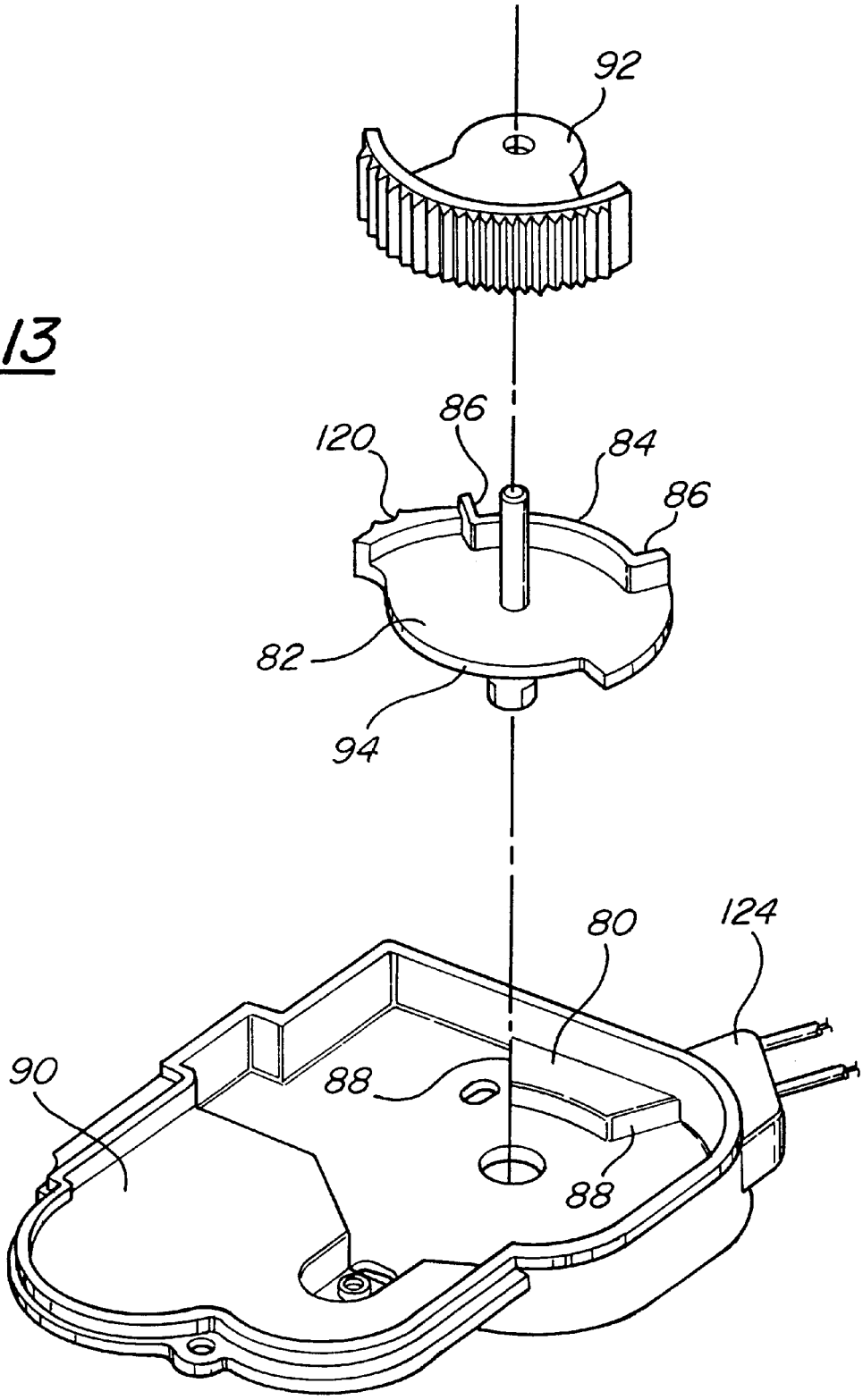
FIG. 13 is a perspective view of an inside surface of an enclosure with the cam in exploded relationship thereto.

The movement of the coupler 34 in relation to the release mechanism 32 is illustrated FIGS. 6 through 8. For illustrative purposes, the pawl 26 is not shown in these Figures. The coupler 34 has an engaged position aligned with the release mechanism 32 for coupling the pawl 26 to the release mechanism 32 wherein movement of the release mechanism 32 moves the pawl 26 to the release position. This coupled position creates an unlocked condition as shown in FIG. 6. As appreciated, the unlocked condition of the door latch assembly 10 shown in FIG. 6 is also the illustrated condition of the door latch assembly 10 in FIGS. 2, 3, and 4. The coupler 34 can then move to a disengaged position spaced from the release mechanism 32 for uncoupling the pawl 26 from the release mechanism 32 wherein the pawl 26 remains in the blocking position during the movement of the release mechanism 32 to retain the ratchet 18 in the latched position. This uncoupled position creates a first locked condition as shown in FIG. 7. Finally, the coupler 34 can move to a further disengaged position spaced farther from the release mechanism 32 which still uncouples the pawl 26 from the release mechanism 32 and creates a second locked condition or a double lock as shown in FIG. 8.

Preferably, the coupler 34 includes a slider 36 having a projecting pin 38 with the pin 38 sliding relative to the release mechanism 32 between the engaged position and the disengaged position. As appreciated, the slider 36 and pin 38 may be of any suitable design or configuration. A guide arm 40 is commonly mounted to the support housing 16 adjacent the pawl 26 to define a channel (not numbered) for receiving the pin 38 of the slider 36 to guide the sliding movement of the pin 38. The coupler 34 includes a locking mechanism 42 pivotally connected to the support housing 16 and engaging the slider 36 for providing the sliding movement of the slider 36 and the pin 38. As appreciated, the preferred embodiment of the coupler 34 includes the slider 36 with the pin 38 and the locking mechanism 42.

An outside lock lever 58 is pivotally connected to the locking mechanism 42 for rotating the locking mechanism 42 and moving the slider 36 to lock the ratchet 18. The locking mechanism 42 further includes an integral slot 60 selectively engaged by the outside lock lever 58 to provide a lost motion connection between the locking mechanism 42 and the outside lock lever 58. As shown in FIGS. 6 through 8, the outside lock lever 58 engages one side of the slot 60 of the locking mechanism 42 to move the locking mechanism 42 to the unlocked condition (FIG. 6); then the outside lock lever 58 engages the other side of the slot 60 of the locking mechanism 42 to move the locking mechanism 42 to the first locked condition (FIG. 7); and then the locking mechanism 42 can be moved to the double locked condition wherein the outside lock lever 58 is disposed within the slot 60 (FIG. 8).

The release mechanism 32 includes a coupling surface 44 for selectively engaging the pin 38 of the slider 36. The release mechanism 32 also includes a first engaging surface 46 spaced from the coupling surface 44 and a second engaging surface 48 spaced from the first engaging surface 46. An outside release lever 50 is pivotally mounted to the support housing 16 and selectively engages the first engaging surface 46 of the release mechanism 32 for moving the release mechanism 32 to release the ratchet 18. As appreciated, the pawl 26, guide arm 40, slider 36, release mechanism 32, and outside release lever 50 are all commonly mounted to a single shaft (not numbered). A retaining coil 52 (see FIG. 4) hooks about the shaft around both the release mechanism 32 and the outside release lever 50 to continuously bias the outside release lever 50 against the first engaging surface 46 of the release mechanism 32.

An inside release lever 54 is pivotally mounted to the support housing 16 and selectively engages the second engaging surface 48 of the release mechanism 32 for moving the release mechanism 32 to also release the ratchet 18. As appreciated, the outside release lever 50 is interconnected to an outer door handle (not shown) and the inside release lever 54 is similarly interconnected to an inner door handle (not shown). The release levers 50, 54 may be connected to the door handles by any suitable device, such as a Bowden wire cable (not shown), as is known in the art. The inside release lever 54 also includes a return spring 56 for continuously biasing the inside release lever 54 toward a non-actuated position.

An inside lock lever 62 is mounted to the inside release lever 54 for preventing the inside release lever 54 from releasing the ratchet 18. As appreciated, the inside release lever 54, return spring 56 and inside lock lever 62 are commonly mounted about a single axis of rotation which is orthogonal to the common shaft for the release mechanism 32.

An interior locking segment 64 is pivotally mounted to the support housing 16 and interconnects the inside lock lever 62 to the locking mechanism 42. As best illustrated in FIGS. 6 through 8, the interior locking segment 64 includes an integral catch 66 and the locking mechanism 42 includes an engagement finger 68 with the engagement finger 68 selectively engaging the catch 66 such that pivotal movement of the locking mechanism 42 pivots the locking segment 64 and actuates the inside lock lever 62. An over-the-center spring 70 is provided for positioning the inside lock lever 62 in either the unlocked or locked condition. Preferably the catch 66 has first 72 and second 74 legs with the finger 68 disposed between the legs 72, 74.

Again, referring to FIGS. 6 through 8, the unlocked condition of the inside lock lever 62 positions the finger 68 near the first leg 72 of the catch 66 (FIG. 6). The first locked condition of the inside lock lever 62 has the finger 68 positioned near the second leg 74 of the catch 66 (FIG. 7). Specifically, the locking segment 64 is toggled to the locked condition which slides the inside lock lever 62. As appreciated, pivotal movement of the locking segment 64 back to the unlocked condition engages the first leg 72 with the finger 68 which also moves the locking mechanism 42 back to the unlocked condition. The double locked condition of the inside lock lever 62 aligns the finger 68 with the tip of the second leg 74 such that if the locking segment 64 begins to pivot, the second leg 74 engages the finger 68 which ceases any further movement of the locking segment 64 (FIG. 8). Hence, in the double locked condition, the locking mechanism 42 cannot be manually moved back into the unlocked condition.

Figure 4:
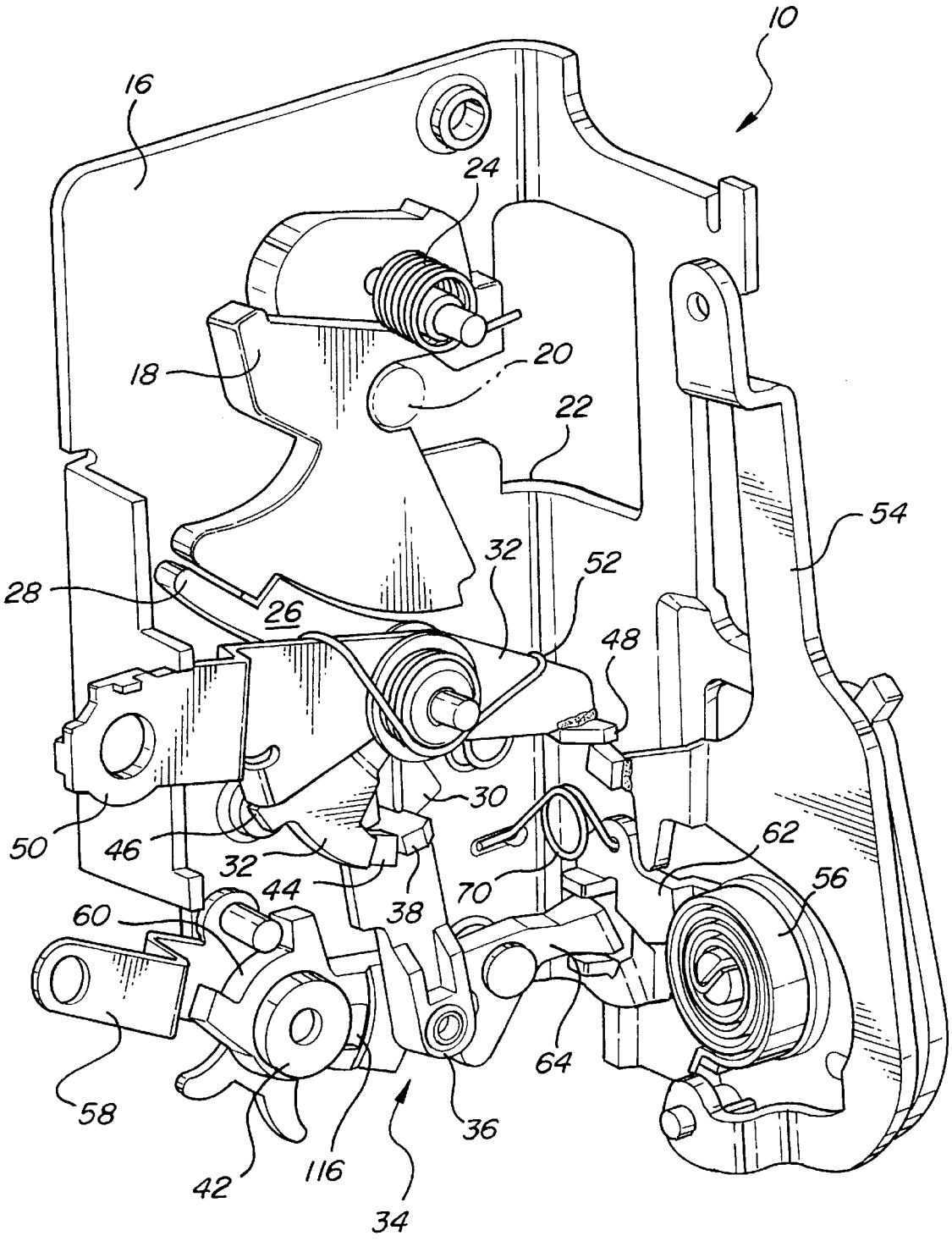
FIG. 4 is a perspective view of the door latch assembly with a number of exterior covers removed to expose the working components.
Figure 5:
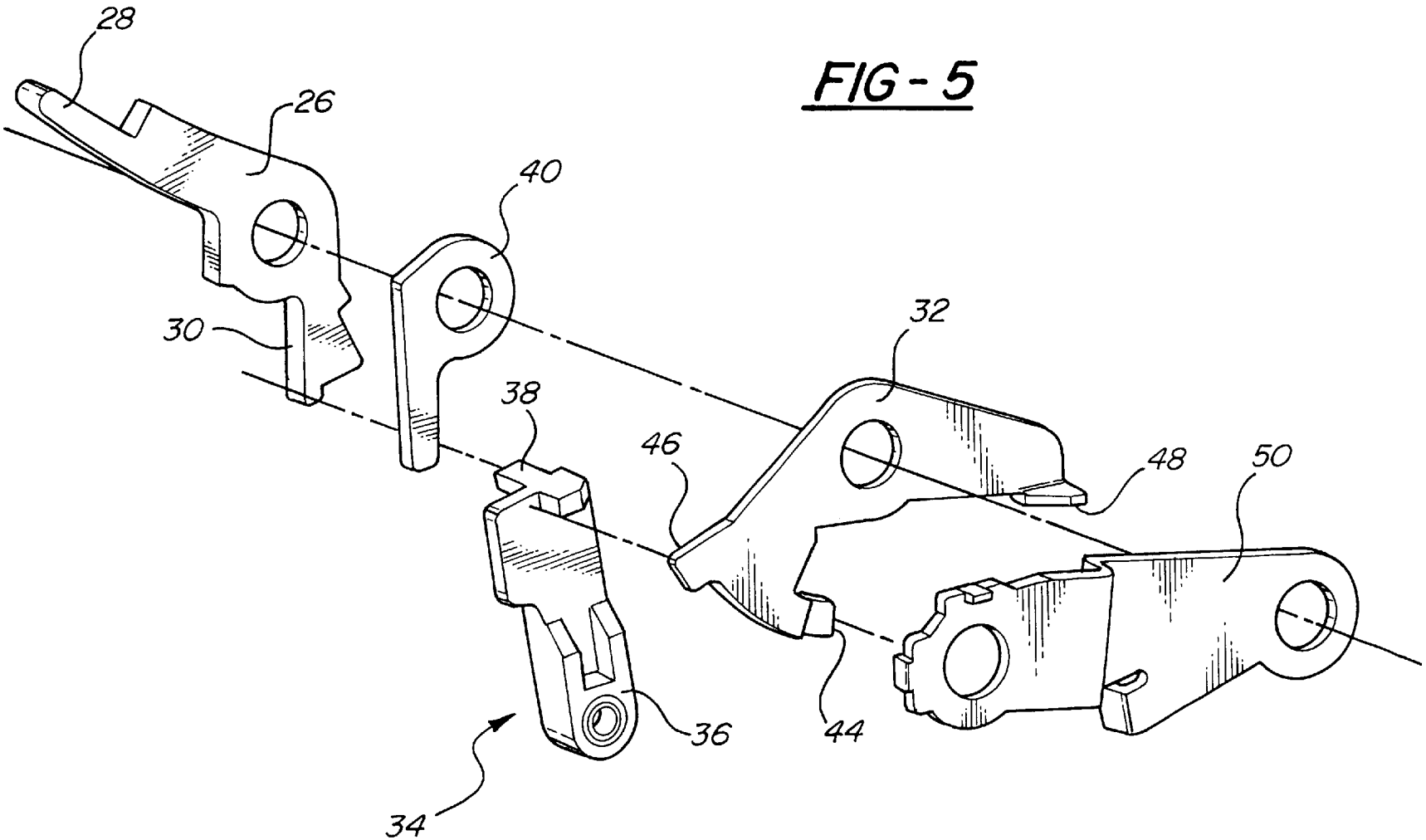
FIG. 5 is an exploded view of a pawl, slider, release mechanism and outside release lever of the door latch assembly.

The general operation of the door latch assembly 10 is now discussed in detail. As discussed above, the door latch assembly 10 has an unlocked condition, a first locked condition and a second locked condition. The unlocked condition is best shown in FIGS. 4 and 6. In this condition, the inside 54 and outside 50 release levers may release the ratchet 18 from the latched position. The locking mechanism 42 is rotated to a rearward most position which retracts the slider 36 to align the pin 38 with the coupling surface 44 of the release mechanism 32. During actuation of the outer door handle, the outside release lever 50 pivots in unison with the release mechanism 32. This in turn moves the coupling surface 44 of the release mechanism 32 into engagement with the pin 38. The pin 38 and slider 36 are then pushed against the second end 30 of the pawl 26. The pivoting of the second end 30 of the pawl 26 pivots the first end 28 out of engagement with the ratchet 18 such that the ratchet 18 may rotate to the unlatched position.

During actuation of the inner door handle, the inside release lever 54 pivots toward the release mechanism 32 and engages the second engaging surface 48 of the release mechanism 32. This in turn also moves the coupling surface 44 of the release mechanism 32 into engagement with the pin 38. As stated above, the pin 38 and slider 36 are then pushed against the second end 30 of the pawl 26. The pivoting of the second end 30 of the pawl 26 pivots the first end 28 out of engagement with the ratchet 18 such that the ratchet 18 may rotate to the unlatched position. The inside lock lever 62, as well as the locking segment 64, do not operate when the door latch assembly 10 is in the unlocked condition.

The first locked condition is shown in FIG. 7. In this condition, the inside release lever 54 may release the ratchet 18 from the latched position but the outside release lever 50 is non-operable. The locking mechanism 42 is rotated to a midway position which moves the slider 36 and positions the pin 38 out of alignment with the coupling surface 44 of the release mechanism 32. The finger 68 of the locking mechanism 42 is also moved to a position adjacent the second leg 74. Specifically, the locking segment 64 is toggled to the locked condition which also slides the inside lock lever 62. The rotational movement of the locking mechanism 42, and subsequent movement of the slider 36 and locking segment 64, may be done manually or remotely. To manually move the locking mechanism 42, the outside lock lever 58 is actuated and engages one side of the integral slot 60. To remotely move the locking mechanism 42, the locking mechanism 42 is rotated by an electrically controlled actuator 76 which is discussed in greater detail hereinbelow. As appreciated, even in the manual operating mode, the electrical actuator 76 may take over the remaining operation.

During actuation of the outer door handle, the outside release lever 50 pivots in unison with the release mechanism 32. This in turn moves the coupling surface 44 of the release mechanism 32 toward the slider 36. However, the pin 38 of the slider 36 is now out of alignment with the coupling surface 44. Hence, the coupling surface 44 simply pivots about the slider 36 and does not engage the slider 36. Accordingly, the pawl 26 is not actuated and the ratchet 18 remains locked in the latched position.

During actuation of the inner door handle, the inside release lever 54 pivots toward the release mechanism 32 and engages the second engaging surface 48 of the release mechanism 32. Simultaneously, the inside release lever 54 engages the inside lock lever 62. Specifically, the inside release lever 54 pushes the inside lock lever 62 back to the unlocked condition which also toggles the locking segment 64 back to the unlocked condition. Accordingly, the first leg 72 of the locking segment 64 engages the finger 68 of the locking mechanism 42 and rotates the locking mechanism 42 back to the unlocked condition. The rotating of the locking mechanism 42 pulls the slider 36 back and re-aligns the pin 38 with the coupling surface 44 of the release mechanism 32. The continued pivoting of the inside release lever 54 moves the coupling surface 44 of the release mechanism 32 into engagement with the pin 38. As stated above, the pin 38 and slider 36 are then pushed against the second end 30 of the pawl 26. The pivoting of the second end 30 of the pawl 26 pivots the first end 28 out of engagement with the ratchet 18 such that the ratchet 18 may rotate to the unlatched position.

The second locked, or double locked, condition is shown in FIG. 8. In this condition, both the inside 54 and outside 50 release levers are non-operable. The locking mechanism 42 is rotated to a forward most position which moves the slider 36 and positions the pin 38 out of further alignment with the coupling surface 44 of the release mechanism 32. The finger 68 of the locking mechanism 42 is moved further to a position aligned with the tip of the first leg 72. The rotational movement of the locking mechanism 42, and subsequent movement of the slider 36, may only be done remotely. As discussed above, the remote actuation of the locking mechanism 42 is done by the electrical actuator 76 and is discussed in greater detail below.

During actuation of the outer door handle, the outside release lever 50 pivots in unison with the release mechanism 32. This in turn moves the coupling surface 44 of the release mechanism 32 toward the slider 36. However, the pin 38 of the slider 36 is still out of alignment with the coupling surface 44. Hence, the coupling surface 44 simply pivots about the slider 36 and does not engage the slider 36. Accordingly, the pawl 26 is not actuated and the ratchet 18 remains locked in the latched position.

During actuation of the inner door handle, the inside release lever 54 pivots toward the release mechanism 32 and engages the second engaging surface 48 of the release mechanism 32. Simultaneously, the inside release lever 54 engages the inside lock lever 62. Specifically, the inside release lever 54 pushes against the inside lock lever 62 which attempts to slide the inside lock lever 62 and toggle the locking segment 64 back to the unlocked condition. Due to the position of the finger 68 in relation to the tip of the first leg 72, the locking segment 64 cannot pivot back to the unlocked position and the locking mechanism 42 remains in the double locked condition. The continued pivoting of the inside release lever 54 moves the coupling surface 44 of the release mechanism 32 toward the slider 36. However, as above, the pin 38 of the slider 36 is still out of alignment with the coupling surface 44. Hence, the coupling surface 44 simply pivots about the slider 36 and does not engage the slider 36. Accordingly, the pawl 26 is not actuated and the ratchet 18 remains locked in the latched position.

Figure 2:
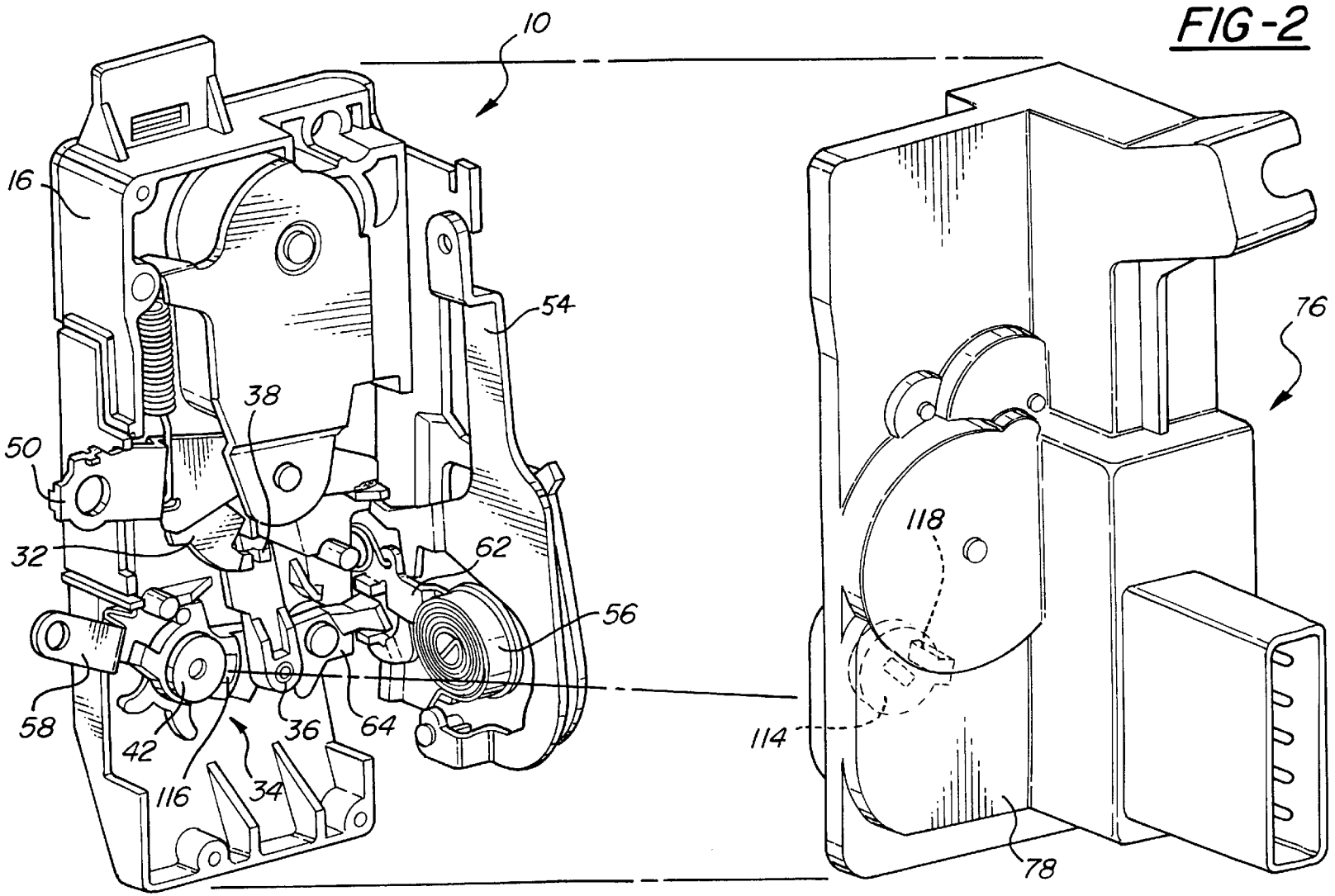
FIG. 2 is a perspective view of a door latch assembly with an electrically controlled actuator in spaced relationship thereto.
Figure 3:
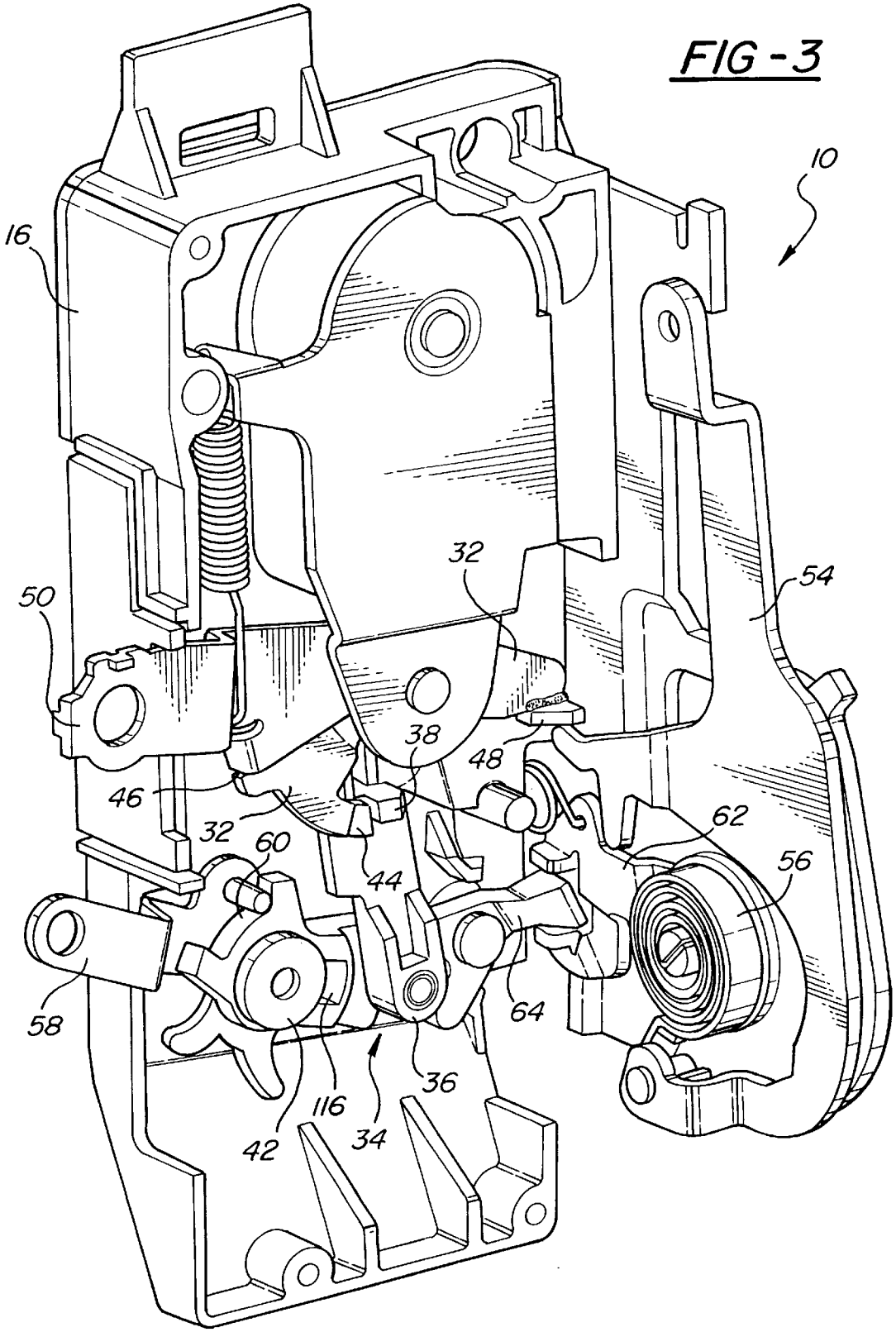
FIG. 3 is a perspective view of the door latch assembly

The remote actuation of the door latch assembly 10 is now discussed in greater detail with reference to FIGS. 9 through 13. Specifically, the electronically controlled actuator is generally shown at 76 in FIGS. 2 and 9. The electrical actuator 76 moves the components of the door latch assembly 10 between the unlocked condition, the first locked condition and the second locked condition. The electrical actuator 76 comprises a cover 78 having at least one projecting abutment 80. As shown in FIG. 2, the cover 78 is designed to fit over, surround, and work in conjunction with the door latch assembly 10.

Referring back to FIGS. 9 through 13, a cam 82 is rotatably mounted to the cover 78. The cam 82 includes a camming surface 84 defining at least one stop 86 for selective engagement with the abutment 80. Specifically, the camming surface 84 comprises an integral notch 84 formed within the cam 82. The integral notch 84 includes at least two stops 86 formed on opposing sides of the notch 84. As appreciated, the notch 84 may be of any suitable depth or size depending upon the particular application. The projecting abutment 80 includes at least a pair of spaced abutting surfaces 88. Preferably, the projecting abutment 80 comprises a single projecting block 80 having two opposing abutting surfaces 88. As illustrated best in FIG. 13, an enclosure 90 is preferably mounted to the cover 78 wherein the abutment 80 is mounted to the enclosure 90. The abutment 80 therefore projects outward from the enclosure 90 and into the cover 78 for selective engagement by the cam 82.

A sector gear 92 is mounted to the cam 82 for providing rotational movement of the cam 82. The cam 82 further includes a second integral notch 94 with the sector gear 92 movably seating within the second notch 94 to create a lost motion connection between the cam 82 and the sector gear 92. Although not illustrated, there is preferably a 15° gap between the sector gear 92 and the cam 82 to define the lost motion connection. A cam return spring 96, having first and second ends, has the first end selectively mounted to the sector gear 92 for continuously biasing the cam 82 to the unlocked condition. A bottom plate 98 is mounted to the second end of the cam return spring 96. The cover 78 further includes a pair of spaced projections 100 with one of the projections engaging the bottom plate 98 to secure the bottom plate 98 in a desired rotational position and the other projection 100 engages the first end of the cam return spring 96 to limit the rotation of the cam return spring 96.

A rocker 102 is movably mounted to the cover 78 for selectively engaging the camming surface 84 of the cam 82. Specifically, the rocker 102 selectively rides within the integral notch 84 and engages one of the stops 86 defined by the integral notch 84. A rocker return spring 104 is mounted to the rocker 102 for continuously biasing the rocker 102 to the engaged position within the integral notch 84.

As illustrated in FIGS. 10 through 12, a first controller, generally shown at 106, rotates the cam 82 to a first position wherein the stop 86 engages the abutment 80 and the rocker 102 engages the camming surface 84 for defining the unlatched condition of the door lock assembly 10. Specifically, one of the stops 86 of the integral notch 84 engages one of the abutting surfaces 88 of the block 80 as shown in FIG. 10. The first controller 106 can then move the cam 82 to a second position wherein the rocker 102 engages the stop 86 to prevent further rotation of the cam 82 and define the first locked condition. Specifically, the rocker 102 engages the opposing stop 86 within the integral notch 84 as shown in FIG. 11. Finally, the first controller 106 can rotate the cam 82 to a third position wherein the stop 86 engages the abutment 80 and the rocker 102 is released from the camming surface 84 to define the second locked condition. Specifically, the opposing stop 86 of the integral notch 84 engages the other abutting surface 88 of the block 80 and the rocker 102 is pivoted out of the integral notch 84 as shown in FIG. 12. A second controller 108 rotates the rocker 102 to release the rocker 102 from the camming surface 84 during rotation of the cam 82 from the second position to the third position. This design incorporates two controllers for providing a three stop position operation.

As shown the preferred embodiment, a pair of stops 86 are formed within the cam 82 and a pair of abutting surfaces 88 are formed within the enclosure 90 of the cover 78. As appreciated, there may be any number of stops 86 and/or abutting surfaces 88 so long as three physical stops are created for the cam 82. In fact there may be only one stop 86 and one abutment 80 such that the cam 82 rotates a full 360°. In addition, the stop or stops 86 may be formed on the cover 78 and the abutting surface or surfaces 88 may be formed on the cam 82 without deviating from the overall scope of the subject invention. As also appreciated, the cam 82, rocker 102 and gearing arrangement may be of any suitable design in order to accommodate a particular abutment/stop arrangement.

The first controller 106 further includes an electric motor 110 for providing the rotational motion of the cam 82. The first controller 106 also includes a plurality of sprocket gears 112 interengaging the motor 110 with the sector gear 92 of the cam 82. Hence, the motor 110 is geared down through the sprocket gears 112 in order to rotate the cam 82. The second controller 108 similarly includes an electric motor 108 for providing the movement of the rocker 102. The electric motor 108 of the second controller 108 is preferably connected directly to the rocker 102.

A transfer element 114 is mounted to the cam 82 and engages the coupler 34 for transferring the rotation of the cam 82 into the movement of the coupler 34. In other words, the transfer element 114 interconnects the electrical actuator 76 to the door latch assembly 10. Specifically, the transfer element 114 engages the locking mechanism 42 for transferring the rotation of the cam 82 into the movement of the slider 36. Preferably, the locking mechanism 42 includes an aperture 116 and the transfer element 114 includes a projecting tab 118 wherein the tab 118 engages the aperture 116 such that rotation of the transfer element 114 between the unlocked, first locked and second locked conditions rotates the locking mechanism 42 and moves the slider 36 between the engaged and disengaged positions.

The cam 82 also includes a plurality of undulations 120 disposed about an outer surface thereof between the notches 84, 94. A cam control switch 122 engages the undulations 120 of the cam 82 such that the rotational movement of the cam 82 may be monitored by movement of the cam control switch 122. The cam control switch 122 may be used to set and reset the positions of the various parts of the electrical actuator 76. A central lock switch 124 is also mounted to the cover 78 and engages the coupler 34 such that the movement of the coupler 34 may be monitored by movement of the central lock switch 124. Specifically, the central lock switch 124 engages the locking mechanism 42 for sending a signal to the other lock assemblies in the vehicle 14 to operate. Finally, a latch control switch 126 is mounted to the cover 78 and engages the ratchet 18 such that the movement of the ratchet 18 may be monitored by movement of the latch control switch 126. The latch control switch 126 primarily monitors whether the ratchet 18 and door 12 is fully latched against the vehicle 14.

The invention has been described in an illustrative manner, and it is to be understood that the terminology which has been used is intended to be in the nature of words of description rather than of limitation. Many modifications and variations of the present invention are possible in light of the above teachings. It is, therefore, to be understood that within the scope of the appended claims the invention may be practiced otherwise than as specifically described.

What is claimed is:

1. An electronically controlled actuator for controlling a door latch assembly between an unlocked condition, a first locked condition and a second locked condition, said actuator comprising;

a cover having at least one projecting abutment;

a cam rotatably mounted to said cover and including a camming surface defining at least one stop for selective engagement with said abutment;

a rocker movably mounted to said cover for selectively engaging said camming surface of said cam;

a first controller for rotating said cam between a first position wherein said stop engages said abutment and said rocker engages said camming surface for defining the unlatched condition of the door lock; a second position wherein said rocker engages said stop to prevent further rotation of said cam and define the first locked condition; and a third position wherein said stop engages said abutment and said rocker is released from said camming surface to define the second locked condition; and a second controller for rotating said rocker to release said rocker from said camming surface during rotation of said cam from said second position to said third position.

2. The actuator as set forth in claim 1 wherein said camming surface comprises an integral notch formed within said cam.

3. The actuator as set forth in claim 2 wherein said integral notch includes at least two stops formed on opposing sides of said notch.

4. The actuator as set forth in claim 3 wherein said projecting abutment includes at least a pair of spaced abutting surfaces.

5. The actuator as set forth in claim 3 wherein said projecting abutment comprises a single projecting block having two opposing abutting surfaces.

6. The actuator as set forth in claim 4 further including an enclosure mounted to said cover with said abutment mounted to said enclosure.

7. The actuator as set forth in claim 4 wherein said rocker selectively rides within said notch and engages one of said stops defined by said integral notch.

8. The actuator as set forth in claim 7 further including a rocker return spring mounted to said rocker for continuously biasing said rocker to said engaged position with said integral notch.

9. The actuator as set forth in claim 7 further including a sector gear mounted to said cam for providing rotational movement of said cam.

10. The actuator as set forth in claim 9 further including a cam return spring having first and second ends with said first end selectively mounted to said sector gear for continuously biasing said cam to said unlocked position.

11. The actuator as set forth in claim 10 further including a bottom plate mounted to said second end of said cam return spring.

12. The actuator as set forth in claim 11 wherein said cover further includes a pair of spaced projections with one of said projections engaging said bottom plate to secure said bottom plate in a desired rotational position and the other of said projections engaging said first end of said cam return spring to limit the rotation of the cam return spring.

13. The actuator as set forth in claim 12 wherein said cam further includes a second integral notch with said sector gear movably seating within said second notch to create a lost motion connection between said cam and said sector gear.

14. The actuator as set forth in claim 9 wherein said first controller further includes an electric motor for providing said rotational motion of said cam.

15. The actuator as set forth in claim 14 wherein said first controller further includes a plurality of sprocket gears interengaging said motor with said sector gear of said cam.

16. The actuator as set forth in claim 15 wherein said second controller further includes an electric motor for providing said movement of said rocker.

17. The actuator as set forth in claim 7 further including a support housing with said cover covering said support housing to enclose the door latch assembly.

18. The actuator as set forth in claim 17 further including a ratchet and a pawl pivotally mounted to said support housing with said pawl moveable between a blocking position to secure said ratchet in a latched position and a release position to permit said ratchet to pivot toward an unlatched position.

19. The actuator as set forth in claim 18 further including a release mechanism mounted to said support housing for selectively moving said pawl into said release position.

20. The actuator as set forth in claim 19 further including a locking mechanism pivotally mounted to said support housing.

21. The actuator as set forth in claim 20 further including a slider rotatably mounted to said locking mechanism to slidably move relative to said release mechanism.

22. The actuator as set forth in claim 21 wherein said slider and said locking mechanism define a coupler coupled between said pawl and said release mechanism and moveable between an engaged position and a disengaged position for selectively coupling said release mechanism to said pawl.

23. The actuator as set forth in claim 22 further including an outside release lever and an inside release lever each pivotally mounted to said support housing and selectively engageable with said release mechanism for moving said release mechanism to release said ratchet.

24. The actuator as set forth in claim 23 further including an interior locking segment pivotally mounted to said support housing and interconnecting one of said outside and inside release levers to said locking mechanism.

25. The actuator as set forth in claim 24 wherein said locking segment interconnects said inside release lever to said locking mechanism.

26. The actuator as set forth in claim 25 wherein said locking segment moves between an unlocked condition, a first locked condition, and a second locked condition with said inside release lever having unobstructed movement when said locking segment is in said unlocked and first locked conditions, and being prevented from releasing said ratchet when said locking segment is in said second locked condition.

27. The actuator as set forth in claim 24 further including a transfer element mounted to said cam and engaging said coupler for transferring said rotation of said cam into said movement of said coupler.

28. The actuator as set forth in claim 27 wherein said cam includes a plurality of undulations disposed about an outer surface thereof.

29. The actuator as set forth in claim 28 further including a cam control switch engaging said undulations of said cam such that said rotational movement of said cam may be monitored by movement of said cam control switch.

30. The actuator as set forth in claim 27 further including a central lock switch mounted to said cover and engaging said coupler such that said movement of said coupler may be monitored by movement of said lock mechanism switch.

31. The actuator as set forth in claim 30 further including a latch control switch mounted to said cover and engaging said ratchet such that said movement of said ratchet may be monitored by movement of said latch control switch.

* * * * *